US007699414B1

(12) United States Patent
Shevrin

(10) Patent No.: US 7,699,414 B1
(45) Date of Patent: Apr. 20, 2010

(54) DRAWER COVER TO PREVENT JAMS

(76) Inventor: Rhonda Shevrin, 408 S. Cranford Rd., Cherry Hill, NJ (US) 08003

( * ) Notice: Subject to any disclaimer, the term of this patent is extended or adjusted under 35 U.S.C. 154(b) by 320 days.

(21) Appl. No.: 11/694,531

(22) Filed: Mar. 30, 2007

(51) Int. Cl.
*A47B 88/00* (2006.01)

(52) U.S. Cl. ..... 312/291

(58) Field of Classification Search ..... 312/291, 312/301, 348.3, 204; 220/254.1, 254.3, 254.4, 220/254.9
See application file for complete search history.

(56) References Cited

U.S. PATENT DOCUMENTS

| | | | | | |
|---|---|---|---|---|---|
| 337,798 | A | | 3/1886 | Sweney | |
| 589,159 | A | | 8/1897 | Burt | |
| 688,010 | A | * | 12/1901 | Simmons | 312/270.3 |
| 1,120,028 | A | | 12/1914 | Cole | |
| 1,443,352 | A | | 1/1923 | Dysthe | |
| 1,480,537 | A | | 1/1924 | Heller | |
| 1,704,964 | A | * | 3/1929 | Dilg | 312/296 |
| 1,883,785 | A | | 10/1932 | Hamm | |
| 2,676,865 | A | | 4/1954 | Allen | |
| 2,686,922 | A | | 8/1954 | LaVigne | |
| 2,769,677 | A | * | 11/1956 | Courson et al. | 312/308 |
| 2,852,882 | A | | 9/1958 | David | |
| 3,041,124 | A | * | 6/1962 | Armstrong | 312/270.1 |
| 3,241,900 | A | * | 3/1966 | Hamilton et al. | 312/194 |
| 3,251,636 | A | * | 5/1966 | Hein | 312/122 |
| 3,826,550 | A | * | 7/1974 | Propst et al. | 312/107 |
| 4,010,989 | A | * | 3/1977 | Klug | 312/204 |
| 4,156,549 | A | | 5/1979 | Clark | |
| 4,386,264 | A | | 5/1983 | Homer | |
| 5,037,165 | A | * | 8/1991 | Rapp et al. | 312/330.1 |
| 5,044,059 | A | * | 9/1991 | De Giulio | 29/401.1 |
| 5,222,789 | A | | 6/1993 | Yoshikawa | |
| 5,275,291 | A | * | 1/1994 | Sledge | 206/531 |
| 5,322,365 | A | * | 6/1994 | Teufel et al. | 312/330.1 |
| 5,443,311 | A | * | 8/1995 | Kadlecek et al. | 312/308 |
| 5,607,213 | A | * | 3/1997 | Slivon et al. | 312/301 |
| 5,988,779 | A | | 11/1999 | Tu et al. | |
| 6,525,298 | B1 | | 2/2003 | Hunts | |
| 6,811,232 | B2 | * | 11/2004 | Doan et al. | 312/291 |
| 7,547,050 | B1 | * | 6/2009 | Miglieri et al. | 292/84 |
| 2006/0152116 | A1 | * | 7/2006 | Shevrin | 312/348.3 |
| 2006/0250062 | A1 | * | 11/2006 | Janda et al. | 312/402 |

FOREIGN PATENT DOCUMENTS

DE 2437552 2/1976

(Continued)

*Primary Examiner*—Janet M Wilkens
(74) *Attorney, Agent, or Firm*—Michael I Kroll

(57) ABSTRACT

A cover for a drawer to prevent objects placed therein from obstructing the movement of the drawer when it is opened or closed. The cover has a guard member in the form of a sheet with a flange member secured on one end there of. The flange member in conjunction with at least one fastener secures the cover to the drawer back. The at least one fastener may be a screw, bolt, or other similar fastener. The flange member may be provided with a number of apertures that corresponds to the number of fasteners. The at least one fastener may be a hook and loop fastener commonly known as Velcro®. The hook and loop fastener allows the user to install and remove the cover without the use of tools.

9 Claims, 9 Drawing Sheets

FOREIGN PATENT DOCUMENTS

| | | | |
|---|---|---|---|
| DE | 3202304 | | 7/1983 |
| EP | 0488548 | | 6/1992 |
| EP | 536583 | | 4/1993 |
| GB | 2010671 | | 7/1979 |
| GB | 2274486 | * | 7/1994 |
| JP | 3170107 | | 7/1991 |

* cited by examiner

DRAWER COVER TO PREVENT JAMS

BACKGROUND OF THE INVENTION

1. Field of the Invention

The present invention relates generally to storage receptacles and, more specifically, to a drawer cover to prevent objects positioned within the drawer from engaging a structural member, such as the frame of a cabinet which can impede the movement of the drawer while being opened or closed. The device comprises is formed from a planar transparent plastic sheet having a top side and a bottom side with a flange depending from one end forming a means for attaching the cover to a drawer.

The drawer cover of the present invention provides a cover for drawer articles to prevent the drawer from jamming during opening and closing operations.

The present invention provides for a semi-permanent attachment and a releasable attachment as desired by the user. For semi-permanent fasteners the flange has a plurality of apertures whereby fasteners, such as screws, can be inserted therein to secure the drawer cover flange into a mating engagement with the interior back side of the drawer with the top edge of the cover within the rise of the drawer sides. For releasable fasteners a length of hook and loop material is fixedly attached to the drawer cover with a mating length of hook and loop material fixed to the interior back side of the drawer so that the cover can be releasably attached to the drawer mating hook and loop material as desired.

2. Description of the Prior Art

There are other cover devices designed for drawers. Typical of these is U.S. Pat. No. 337,798 issued to Sweney on Mar. 9, 1886.

Another patent was issued to Burt on Aug. 31, 1897 as U.S. Pat. No. 589,159. Yet another U.S. Pat. No. 1,120,028 was issued to Cole on Dec. 8, 1914. U.S. Pat. No. 1,443,352 was issued to Dysthe on Jan. 30, 1923, and another was issued on Jan. 8, 1924 to Heller as U.S. Pat. No. 1,480,537.

Another patent was issued to Hamm on Oct. 18, 1932 as U.S. Pat. No. 1,883,785. Yet another U.S. Pat. No. 2,676,865 was issued to Allen on Apr. 27, 1954. Another was issued to LaVigne on Aug. 24, 1954 as U.S. Pat. No. 2,686,922, and still yet another was issued on Sep. 23, 1958 to David as U.S. Pat. No. 2,852,882.

Another U.S. Pat. No. 4,156,549 was issued to Clark on May 29, 1979 and another patent was issued to Horner on May 31, 1983 as U.S. Pat. No. 4,386,264. Yet another U.S. Pat. No. 5,222,789 was issued to Yoshikawa on Jun. 29, 1993. Another was issued to Kadlecek, et al. on Aug. 22, 1995 as U.S. Pat. No. 5,443,311 and still yet another was issued on Mar. 4, 1997 to Slivon, et al. as U.S. Pat. No. 5,607,213.

Another patent was issued to Tu, et al. on Nov. 23, 1999 as U.S. Pat. No. 5,988,779. Yet another U.S. Pat. No. 6,525,298 was issued to Hunts on Feb. 25, 2003. Another was issued to Ringelhan, et al. on Feb. 19, 1976 as German Patent No. DE2437552 and still yet another was issued on Jul. 4, 1979 to Doherty as U.K. Patent No. GB2010671.

Another patent was issued to Miesen on Jul. 28, 1983 as German Patent No. DE3202304. Yet another Japan Patent No. JP3170107 was issued to Yae on Jul. 23, 1991. Another was published to Yoshikawa on Jun. 3, 1992 as European Patent Application No. EP0488548 and still yet another was published on Apr. 14, 1993 to Rogic as European Patent Application No. EP0536583.

U.S. Pat. No. 337,798

Inventor: Thomas W. Sweney

Issued: Mar. 9, 1886

A cabinet having a plurality of drawers incorporating an in use indicator whereby a person leaving an article to be repaired or deposited for safe keeping, whereupon an attendant would go to the cabinet and select one of the unoccupied drawers, by reason of the indicator being turned with its blank side out, and place the article inside handing the check to the owner of the article and reversing the indicator thereby indicating that the drawer is in use. Each of the drawers can be removed from the cabinet and having a slidably movable lid that will prevent the contents from spilling out should the drawer be dropped.

U.S. Pat. No. 589,159

Inventor: Horace R. Burt

Issued: Aug. 31, 1897

A device designed to cover and protect the contents of drawers having a roller journaled in bearings secured to a fixed support, a flexible cover secured at one end to the inner end of the drawer and at the other end to the roller and means for automatically operating the roller to wind and unwind the cover on pulling out and pushing in the drawer.

U.S. Pat. No. 1,120,028

Inventor: Dwight S. Cole

Issued: Dec. 8, 1914

The invention is a cabinet frame having a drawer therein and a belt having a reciprocating movement on supporting members carried by the frame over the drawer to effect such movement by the opening and closing of the drawer that only that part of the belt which moves in the drawer's direction of movement can engage the drawer's contents.

U.S. Pat. No. 1,443,352

Inventor: Martinius Dysthe

Issued: Jan. 30, 1923

A cover structure for drawers comprising a frame and a drawer slidably mounted therein with the cover slidably mounted in the side of said drawer and flexible means pivotally connected to said cover and said frame for limiting the movement of said cover.

U.S. Pat. No. 1,480,537

Inventor: Albert L. Heller

Issued: Jan. 8, 1924

This invention relates to the art of exhibiting; and more specifically to improved means for displaying articles for sale, facilitating the sale and saving time and money in handling and merchandising these articles. One object of my invention is to enhance the attractive appearance of trinkets or small articles of jewelry, intended to be sold individually or in individual sets, when placed on display. Another object is to save time of salesman in inserting the articles for display, or removing them when making a sale. Another object is to conserve showroom space in making display and still display articles effectively, protect them from exposure to dirt and dust and reduce the likelihood of pilfering the articles.

U.S. Pat. No. 1,883,385

Inventor: Bertram C. Hamm

Issued: Oct. 18, 1932

This invention relates to a desk having a top, and a thin slide movable in a guideway under an end portion of the top and usually between the top and an upper drawer, the slide being adapted to be retracted and stored under the top, and projected therefrom for use, and adapted to serve as a support for articles laid on its upper surface when the slide is projected:

U.S. Pat. No. 2,676,865

Inventor: Eddie Allen

Issued: Apr. 27, 1954

This invention relates to cabinets, and particularly to cabinets designed for use by hair dressers, manicurists or the like, the primary object of the invention being to provide a drawer which is so constructed and arranged that it may be withdrawn from the cabinet to expose the entire contents of the drawer, the drawer remaining in a horizontal or supported position providing a shelf for easy access to the articles contained therein.

U.S. Pat. No. 2,686,922

Inventor: Eugene E. LaVigne

Issued: Aug. 24, 1954

This invention relates to hospital equipment and, more particularly, to a certain new invention in bassinets which incorporate a dressing stand. Heretofore hospital nurseries have utilized bassinets for newly born babies which consist solely of a preferably metal basket normally disposed in immediate side-by-side relations to adjacent bassinets. With bassinets of this type, it is requisite, for dressing purposes, that nursery attendants remove the babies to a common dressing table from the bassinet for change of diapers, replacement of bandages, and the like. This procedure entails a change of dressing table cover and the provision of clean materials before each dressing operation in order to avoid any spread of infection. Unfortunately, in times of heavy activity such precautions are often overlooked, and the transmittance of infection, such as impetigo, respiratory diseases, and others, is facilitated within the nursery with consequent disquieting results.

U.S. Pat. No. 2,852,882

Inventor: Johnnie David

Issued: Sep. 23, 1958

This invention relates to a stand or cabinet adapted to have a telephone instrument supported on it and to be attached to the instrument and moved about with it. The stand or cabinet is of the same size as the base of the telephone and is shallow and contains a drawer for containing a memorandum pad and pencils and the like so that they are always with the telephone and readily available. The utility of the device is that the memorandum pad and pencil are always available and remain with the telephone since the stand or cabinet is attached to the base of the phone by spring clips or comparable means. The drawer in the stand or cabinet is arranged to open automatically by one merely touching a finger panel or latch at the end of the stand and close to the telephone dial so that the memorandum pad and pencil can be reached with the maximum of ease and facility.

U.S. Pat. No. 4,156,549

Inventor: Marvin A. Clark

Issued: May 29, 1979

A drawer for preventing the entry of insects thereinto is mounted to slide in a frame and has grooves in the sides and front of the drawer. A cover is fixedly mounted in the frame and the drawer grooves slide on the edge of the cover. The cover engages the groove in the front of the drawer when the drawer is closed while the back of the drawer is sealed by the cover overlapping the back side, so that the drawer is sealed against the entry of insects when closed.

U.S. Pat. No. 4,386,264

Inventor: William G. Horner

Issued: May 31, 1983

A guard for deterring thefts from open cash tills. The guard includes a pair of side barriers each of which, in use, projects from the till body in the direction of opening movement of the drawer so as to prevent direct side access to at least the rear of the drawer when in its fully open position and a top barrier extending between the side barriers so as to extend across and directly above at least the rear of the drawer when in its fully open position.

U.S. Pat. No. 5,222,789

Inventor: Koichi Yoshikawa

Issued: Jun. 29, 1993

This invention is directed to a drawer system including a roll-up device comprising a core cylinder and a sheet to cover the upper open surface of a drawer in which the sheet is rolled up onto the core cylinder by elasticity. The sheet roll-up device is placed above the entrance of the drawer and the end of the sheet is secured to the top back side of the drawer so that the sheet can be drawn out from the sheet roll-up device against the elasticity to cover the open surface of the drawer and the articles therein when the drawer is pushed inside of the entrance, when the drawer is moved outwardly the sheet is rolled onto the roll-up device by the elasticity. Rollers may be placed on the ends of the core cylinder, which rotate to feed the sheet out or to feed the sheet onto the drawer as the drawer is moved in and out.

U.S. Pat. No. 5,443,311

Inventor: Alois Kadlecek, et al

Issued: Aug. 22, 1995

A sliding work platform for a drawer includes a flat panel with depending side and rear flanges and a depending tray along the front edge thereof. The drawer side walls are respectively coupled to slide assemblies, each including a runner defining an upwardly opening channel. The platform panel spans the drawer side walls and the side flanges extend down respectively into the channels of the drawer slide runners. The length of the tray is less than the distance between the drawer side walls so that it nests within the drawer. The platform slides forwardly and rearwardly of the drawer between a forward position completely covering the drawer and a rearward position permitting access to the drawer.

U.S. Pat. No. 5,607,213

Inventor: George R. Slivon

Issued: Mar. 4, 1997

A sliding work platform for a drawer, of the type having upstanding front, rear and side walls, includes a substantially rectangular panel which defines a work surface and has front and rear edges and substantially flat side margins. The flat side margins slidably engage the tops of the upstanding side walls of the drawer to facilitate movement of the platform in the forward and rearward direction relative to the drawer. Support members are integrally coupled close to the rear edge of the panel for slidably engaging upper edges of drawer slides to support the platform rearwardly of the drawer. Downwardly depending flanges are integral with the panel side margins near the front edge of the panel to engage the insides of the drawer walls for limiting front-to-back and lateral movement of the platform relative to the drawer. Lips on the flanges engage beneath folded-over upper ends of the drawer side walls to inhibit vertical movement of the platform relative to the drawer.

U.S. Pat. No. 5,988,779

Inventor: Hsin-Hung Tu, et al

Issued: Nov. 23, 1999

An improved document tray for scanners includes a supporting part and covering means. The supporting part is used to hold a document for scanning and the covering means is used to press and fix the document. The covering member does not need to be opened for inserting a document into the supporting part. The document tray of the invention indeed improves the drawbacks of the prior art so that the tray will not jam or be damaged when it is pushed into the scanner.

U.S. Pat. No. 6,525,298

Inventor: Barney D. Hunts

Issued: Feb. 25, 2003

A hot air towel warmer comprising a substantially air tight enclosure having an access door to enable placing a towel to be warmed in the enclosure and to enable removing the warmed towel therefrom; a shelf disposed within the enclosure having perforations therethrough to support the towel; a blower disposed within the enclosure adjacent to the shelf to create a stream of air and to continuously circulate the stream of air within the enclosure for passage through the perforations of the shelf and the towel; a resistance coil heater disposed within the enclosure adjacent the blower to heat the stream of air; an electrical control circuit disposed within the enclosure associated with the stream of air, the blower and the heater to automatically maintain the stream of air at a temperature within a predetermined temperature range for a given period of time or until the access door is open, whichever comes first and to prevent scorching of the towel should a short circuit occur in the parts of the electrical control circuit; and various embodiments to permanently secure the hot air towel warmer to prevent the warmer from falling into either a tub or a shower enclosure.

German Patent Number DE2437552

Inventor: Franz Ringelhan, et al

Issued: Feb. 19, 1976

The indexed filing or storage drawers are provided with a frame (1) for the front plate or panel (2) and with an index case (3) which comprises a transparent cover (7) and a card insert frame (8) which is open on one side. The card index case (3) is designed to slide into one of the two transverse sides of the front panel frame (1) and is thereby formed an insert pocket with lateral insert springs (4). A corresponding recess (5) with lateral insert grooves (6) is provided in the transverse side of the frame (1) so that when the card index case (3) is inserted its transparent cover (7) forms a seal with the surfaces of the frame and the card insert frame (8) is also closed up. In this way the index can be read from both the side and from the front and the cards can be mounted without danger of being lost.

U.K. Patent Number GB2010671

Inventor: Hugh Vincent Doherty

Issued: Jul. 4, 1979

A guard for a till has two side members, which are substantially planar and of opaque material, preferably plastic, bolt holes in an extension of each side member, for attaching the side members to a till or cash register by means of bolts or self tapping screws and a cover portion extending between and located in grooves in the side members. The cover is constructed of transparent plastics.

German Patent Number DE3202304

Inventor: Fahrzeug Miesen

Issued: Jul. 28, 1983

In a cabinet (1), especially in ambulances, the drawers (3) are designed so that they can be removed from the cabinet while being closed on all sides and being portable like a suitcase as a closed unit. For this, the drawer (3) can be closed by a shutter (14) which is carried on it and which can be locked relative to the cabinet via a fixing spring (22) fixed to the cabinet body (2, 6) when the drawer is in the cabinet, so that the shutter which is closed when the drawer is inserted in the cabinet is opened automatically when the drawer is pulled out. On complete removal of the drawer, the fixing spring (22) is pressed by the user into a neutral position, so that it comes out of engagement with the shutter (14), as a result of which the shutter remains closed when the drawer is removed.

Japan Patent Number JP3170107

Inventor: Atsuo Yae

Issued: Jul. 23, 1991

PURPOSE: To prevent dust, etc., from intruding into a cabinet and to hold the cleanliness in a containing part by closing up tightly the opening upper face of a drawer body with a cover at the time of housing it. CONSTITUTION: The device is provided with a drawer body 1 fitted to a cabinet 6 so as to be freely housed and a cover 5 which is superposed to this drawer body edge 3 so as to be freely contactable and separable, and closes up tightly the opening upper face at the time of housing the drawer body. Also, the device is provided with an energizing means A of a cover in which one end thereof and the other end are ranged to the cabinet 6 side and the cover 5 side, respectively and energized in two directions of the direction for closing the cover and the direction of opening it. Moreover, the device is provided with a switching means B for switching the energizing direction of this energizing means A to the closing direction and the opening direction, and an interlocking means C for interlocking this switching means B to drawing-out operation and a housing operation of the drawer body 1, in the cabinet 6. According to such a constitution, as for the drawer body in the cabinet, its opening upper face is covered so as to be closed up tightly with the energized cover.

European Patent Application Number EP0488548

Inventor: Koichi Yoshikawa

Published: Jun. 3, 1992

A drawer system includes a roll-up device (A) comprising a core cylinder (2) and a sheet (1) to cover the upper open surface of a drawer (14) in which the sheet (1) is rolled up onto the core cylinder (2) by elasticity. The sheet roll-up device (A) is placed above the entrance of the drawer (14) and the end of the sheet (1) is secured to the top back side (18) of the drawer (14) so that the sheet (1) can be drawn out from the sheet roll-up device (A) against the elasticity to cover the open surface of the drawer (14) and the articles therein when the drawer (14) is pushed inside the entrance; when the drawer (14) is moved outwardly the sheet (1) is rolled onto the roll-up device (A) by the elasticity. Rollers (28) may be placed on the ends of the core cylinder (2) which rotate to feed the sheet (1) out or to feed the sheet onto the drawer (14) as the drawer is moved in and out.

European Patent Application Number EP0536583

Inventor: Rogic Vladimir

Published: Apr. 14, 1993

The chest of drawers or drawer cupboard (1) possesses case-like drawers (2) which can be closed by swing-up lockable covers (3) and which can be locked in their position pushed into the chest or cupboard. The locks of the drawer and cover can be released by means of a common handle (5).

While these drawer covers may be suitable for the purposes for which they were designed, they would not be as suitable for the purposes of the present invention, as hereinafter described.

SUMMARY OF THE PRESENT INVENTION

A primary object of the present invention is to provide a cover for a drawer to prevent articles from jamming the drawer during opening and closing operations.

An additional object of the present invention is to provide a cover for a drawer to keep drawer articles from contacting structural frame members.

Another object of the present invention is to provide a drawer cover to prevent drawer articles from falling out of the drawer during opening and closing operations.

Yet another object of the present invention is to provide a drawer cover comprising a substantially planar guard member with a substantially planar flange member generally perpendicularly depending from one end of the guard member forming means for attaching the cover to or within a drawer.

Still yet another object of the present invention is to provide a drawer cover that is at least partially transparent whereby drawer articles are easily viewed.

Another object of the present invention is to provide a drawer cover wherein said flange has at least one aperture formed therein whereby the cover can be fastened to the interior surface of the drawer back in a semi-permanent manner by at least one threaded fastener.

Yet another object of the present invention is to provide a drawer cover that is releasably fastened to the interior surface of the drawer back by a hook and loop fastener, where the fastener is made up of mating portions of hook and loop material, where one portion is attached to the flange and the other portion is attached to the interior surface of the drawer back so that when the lengths are matingly engaged the drawer cover functions in similar fashion as the semi-permanent attachment but is removably attached to the drawer.

Additional objects of the present invention will appear as the description proceeds.

The present invention overcomes the shortcomings of the prior art by providing a drawer cover to prevent objects positioned within the drawer from engaging structural members, such as the frame of a cabinet which can impede the movement of the drawer while being opened or closed. The device comprises a planar transparent guard with a flange depending from one end of the guard forming means for attaching the cover to a drawer.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

LIST OF REFERENCE NUMERALS

Figure 1:
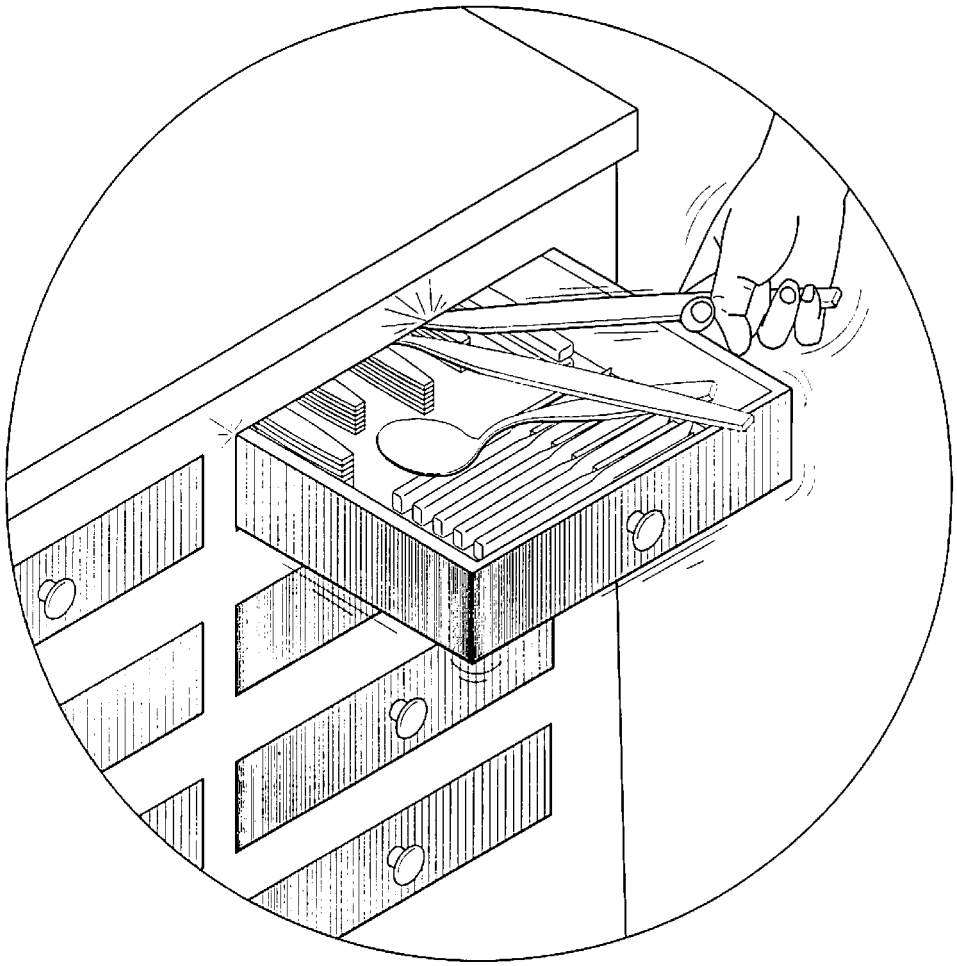
FIG. 1 (PRIOR ART)
FIG. 1 is an illustrative view of prior art.

With regard to reference numerals used, the following numbering is used throughout the drawings.

10 Present Invention
12 Drawer
14 Utensils
16 Guard Member
18 Flange Member
20 Free Edge
22 Threaded Fastener
24 Aperture
26 Hook Portion
28 Loop Portion
30 Bound Portion
32 Unbound Portion
34 Drawer Back
36 Drawer Front
38 Drawer Side
40 Drawer Bottom
42 Drawer Pull
44 Indicia
46 Key Hole
48 Hook and Loop Fastener

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

Turning to FIG. 1, an illustrative view of prior art is shown. A common problem with utensil drawers is when utensils get stuck up in the drawer and cause the drawer to jam, making it difficult to fully open and remove the stuck utensil. The present invention overcomes this problem by providing a device that is installed within the utensil drawer to prevent jamming from occurring. The present invention is not limited to use on a utensil drawer. The utensil drawer is intended as an example and is not intended to limit the scope of the present invention. It is envisioned that the present invention would be employed on any drawer where the content(s) in the drawer may cause the drawer to jam upon opening or closing of the drawer.

Turning now descriptively to the drawings, FIGS. 2-9 illustrate a cover for a drawer of the present invention, which is generally indicated by reference numeral 10.

Figure 2:
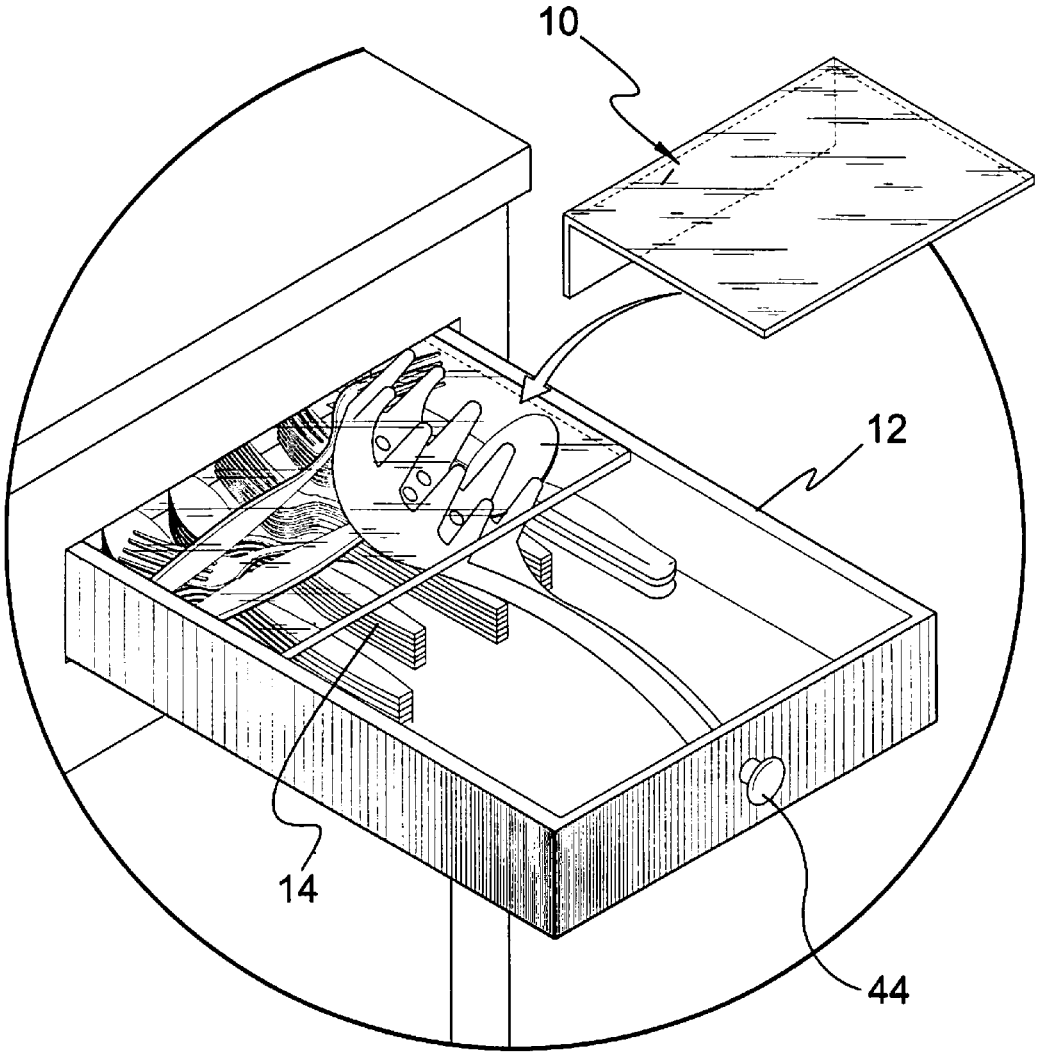
FIG. 2 is an illustrative view of the present invention in use.

FIG. 2, is an illustrative view of the present invention 10 in use is shown. The present invention 10 is a cover for a drawer 12 to prevent objects positioned within the drawer 12 from impeding the movement of the drawer 12 while being opened or closed. The device comprises a guard member 16 having opposed first and second ends and opposed first and second surfaces. The guard member is preferably made so that its first and second surfaces are substantially planar. The term substantially, with respect to the present invention 10, shall allow for variations due to manufacturing tolerances or imperfections that are a result of the manufacturing process. The first or top surface faces away from the drawer bottom 38 and faces the user when the drawer 12 is open. The second or bottom surface faces the drawer bottom 38 when the cover is installed in the drawer 12. The first end terminates in a free edge 20. This end is not secured to the drawer and is essentially cantilevered. The guard member 16 has a flange member 18 downwardly depending from the second end thereof. Flange member 18 has opposed first and second surfaces that are substantially planar. At least one fastener forms the means for attaching the cover to a drawer back 34. The present invention 10 is shown in use on a drawer 12 with utensils 14 but may be employed on a drawer 12 with any contents where the contents in the drawer are likely to cause the drawer 12 to jam when it is opened or closed. The cover may be constructed from a plastic material such as polyethylene, polypropylene, or any other suitable plastic. It is preferable that the guard member 18 be at least partially transparent to allow the user to see the contents of the drawer 12 covered there under. This may be accomplished by employing a transparent material to make the entire cover or by providing transparent portions or areas in the guard member 18. It is envisioned that the guard member 18 may employ indicia 44 (see FIG. 6) such as but not limited to logos, brand names, company names, phone numbers, or any other indicia desired. When indicia is employed on the guard member 18, the guard member 18 will be at least partially transparent to allow the user to see the content there under. It is preferable that the indicia occupy only a portion of the guard member 18. The indicia need not be opaque and may be translucent to allow a user to see there through. It is also envisioned that the flange member 18 may be color coded by providing each flange member with a specific color or tint. The color of the flange member 18 can be used to indicate the width or size of the flange. This will readily indicate in which drawer the cover is to be positioned. The cover may be made from a single sheet of plastic material that is formed or bent to provide the desired "L" shape. The first surface of the flange member 18 forms a first angle with respect to the first surface of the guard member 16. The first angle is an obtuse angle, i.e. greater than 90 degrees. The first surface of the flange member 18 faces the drawer back 34 when the cover is installed in the drawer 12. The second surface of the flange member 18 forms a second angle with the second surface of the guard member 16. The second angle is approximately 90 degrees. It is envisioned that the second angle need not be a perfect right angle and may be slightly less than 90 degrees to prevent interference with the cabinet in which the drawer 12 is located. It is also envisioned that the free edge 20 of the guard member 16 is tapered to reduce the chance that the free edge jamming against the cabinet in which the drawer is located (see FIG. 3).

Figure 3:
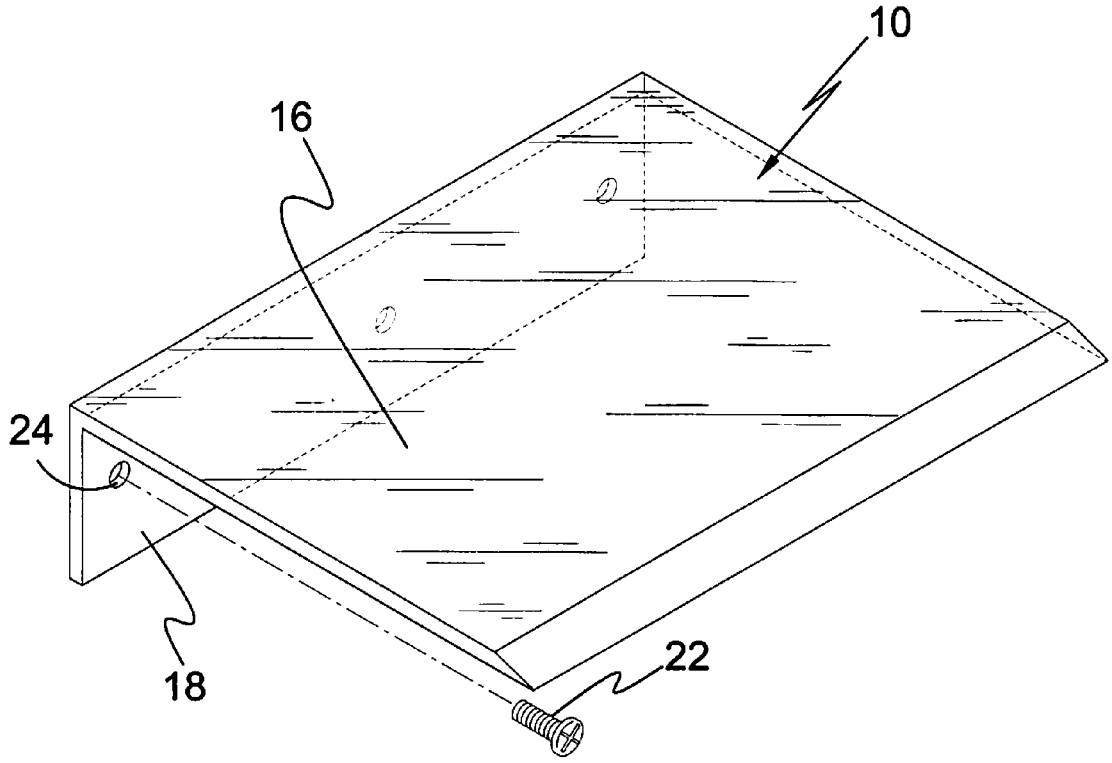
FIG. 3 is a perspective view of an attachment means for the drawer cover.

FIG. 3, is a perspective view of one attachment means for the cover of the present invention 10. As shown, the cover is "L" shaped (in section, see FIG. 8) where the guard member 18 is the vertical part of the "L" and the flange member 18 is the horizontal part of the "L". The surface of the flange member 18 and guard member 16 do not need to be perfectly planar or flat and may have some variations, slight curvatures, or imperfections so long as they do not hinder the performance of the invention. A threaded fastener 22 is shown attaching the cover to the drawer back 34. It is envisioned that at least one fastener is employed to secure the cover to a drawer 12. It is envisioned that the first surface of the flange member 18 may be provided with a roughened or textured area around the aperture 24 that receives the single fastener. This will prevent the cover from shifting when a single fastener is used. It may be desirable to employ a plurality of threaded fasteners 20 to secure the flange member 18 to the drawer back 34. The flange member 18 may be provided with a number of apertures 24 that corresponds to the number of threaded fasteners 22 to be employed. A nut and bolt may be employed in lieu a screw. It is also envisioned that adhesive may be employed on the surface of the flange 18 that contacts the rear wall of the drawer in combination with or in lieu of threaded fasteners 22. The threaded fasteners 22 are secured in or through the drawer back 34 to secure the cover thereon. It is envisioned that the apertures 24 may be in the shape of a keyhole 44 (see FIG. 4) to allow the threaded fasteners 22 to be driven or installed in drawer back 34 prior to positioning the cover in the drawer 12. Once the threaded fasteners 22 are in place, then the cover in placed over the threaded fasteners 22 where the head of the fasteners pass through the larger portion of the keyhole 44. The cover is allowed to slide down where the shaft of each threaded fastener 22 is received into a slot portion of its respective keyhole 44. The threaded fasteners 22 are then tightened to secure the cover to the drawer back 34. It is envisioned that the slot of the keyhole will be positioned closer to the guard member 16 and the larger opening will be closer to the terminal or free edge of the flange member 18. This positioning will ensure that the heads of the fasteners will contact the flange member 18 so that it is securely attached to the drawer 12.

Figure 4:
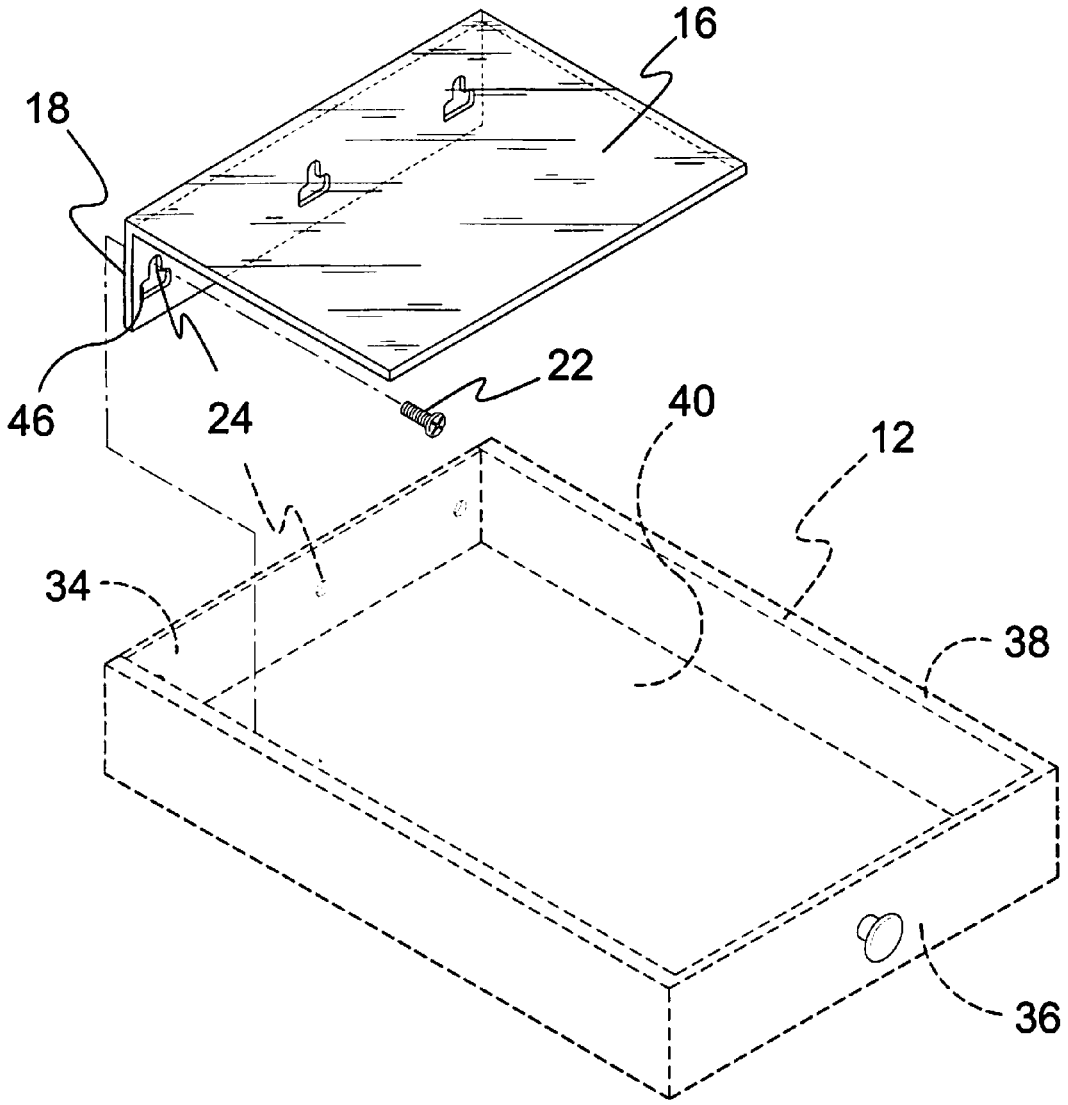
FIG. 4 is a perspective view of the drawer cover and a drawer.

FIG. 4, is a perspective view of the cover and a drawer 12. The cover is "L" shaped where the flange member 18 is the short part of the "L" and the guard member 16 is the long part of the "L". Illustrated is a drawer 12 prepared for installation of the cover by placing apertures 24 in the drawer back 34 which are aligned with the apertures 24 of the flange member 18 so that the threaded fasteners 22, such as screws or bolts or the like, can be inserted there through to secure the flange member 18 to the drawer back 34. The guard member 16 extends only partially across the length of the drawer 12. The guard member 16 extends from the drawer back 34 towards the drawer front 36. The guard member 16 has a terminal end with a free edge 20 that stops short of or is spaced away from the drawer front 34. This creates a bound portion 30 and an unbound portion 32. The bound portion 30 is the area between the flange member 18, the free edge 20, and drawer sides 38. The unbound portion 32 is the area between the drawer front 36, the free edge 20, and the drawer sides 38. The unbound portion enables the user to remove the contents from the drawer 12 while the cover is secured to the drawer 12. This eliminates the need for the user to remove the cover from the drawer 12 to access the contents.

Figure 5:
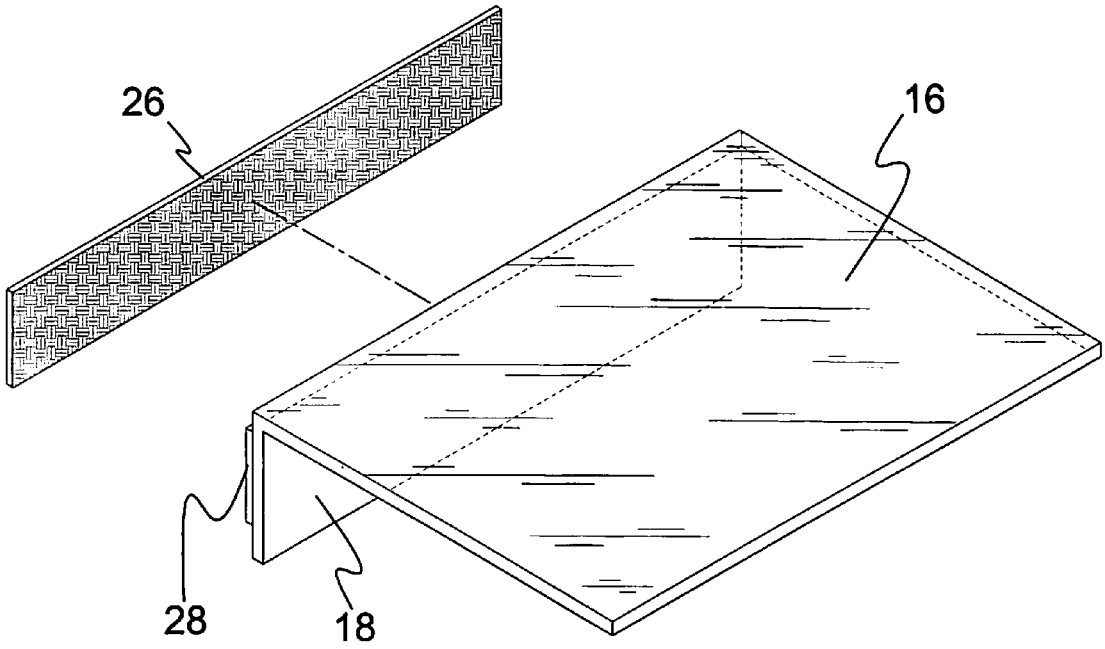
FIG. 5 is a perspective view of another attachment means for the drawer cover.

FIG. 5, is a perspective view of another attachment means for the cover. The at least one fastener shown here is a hook and loop fastener with two portions, a hook portion 26 and a loop portion 28. One portion (one of the hook and the loop) of the fastener is secured to the interior surface of the drawer back 34 and the other portion (the other of the hook and the loop) is secured to the first surface of the flange member 18. It is envisioned that the hook and loop elements may be secured in place with pressure sensitive adhesive or any other suitable adhesive. The hook and loop fastener allows the user to remove and replace the cover without the user of tools. The user may choose to remove the cover to obtain greater access to the contents of the drawer 12. The hook and loop portions mate together to securely retain the cover in place.

Figure 6:
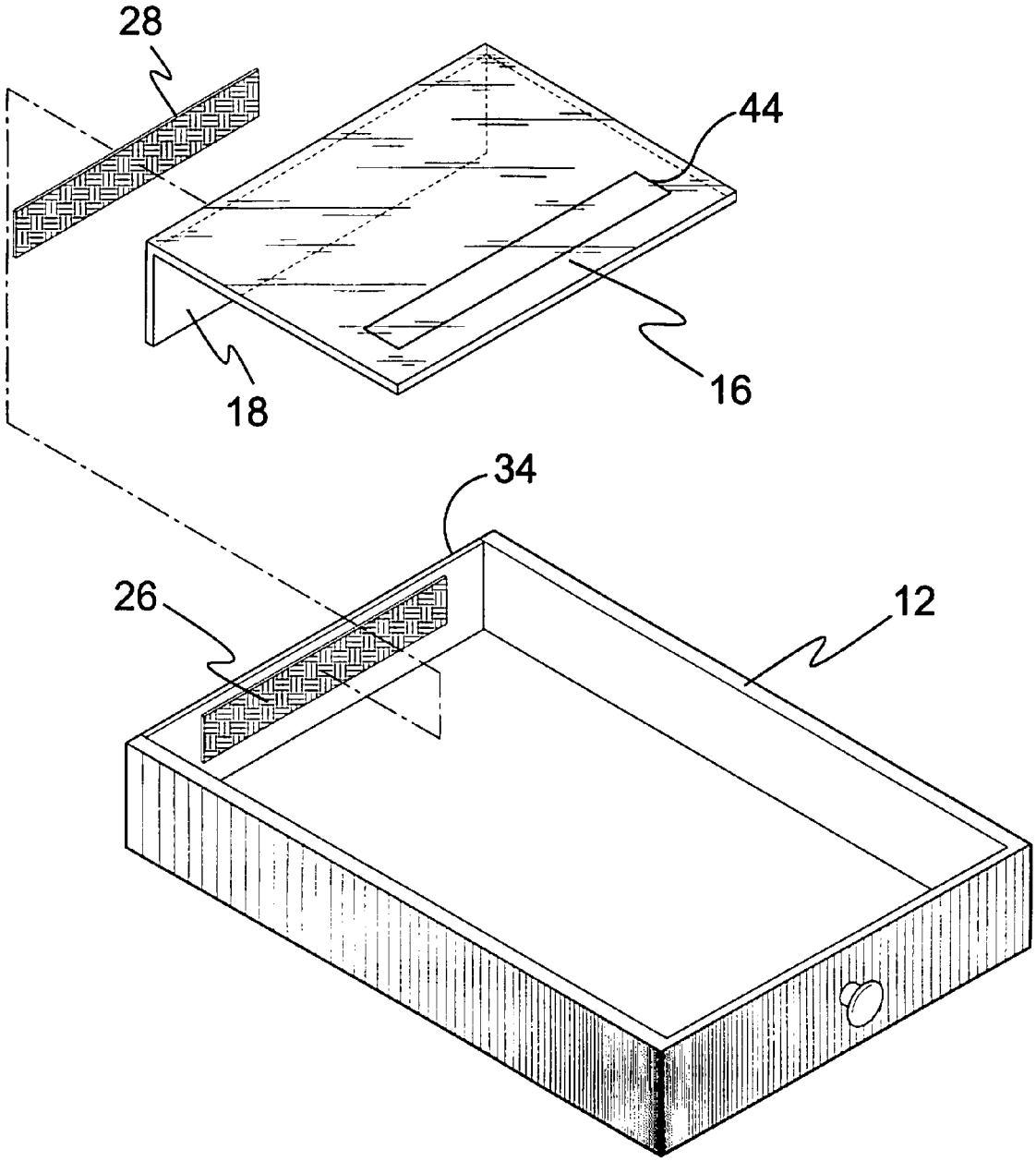
FIG. 6 is a perspective view of the drawer cover and a drawer.

FIG. 6, is a perspective view of the cover and a drawer 12. Here the mating portions of the hook and loop fastener 20 are shown. The hook portion 26 is secured to one of the flange member 18 and the drawer back 34 and the loop portion is secured to the other. The hook portion 26 and the loop portion 28 may be secured in place by a suitable adhesive. The guard extends forward across only a portion of the drawer bottom 40. The cover has a width that is less than the distance between the drawer sides 38. This enables the first or top surface of the guard member 18 to be positioned at or below the top edge of the drawer sides 38 to ensure that the cover does not bind or jam with the cabinet in which the drawer 12 is located. It is envisioned that the cover has a width that is approximately equal to the distance between the drawer sides 38. This will prevent a significant gap between the guard member 18 and the drawer sides 38.

Figure 7:
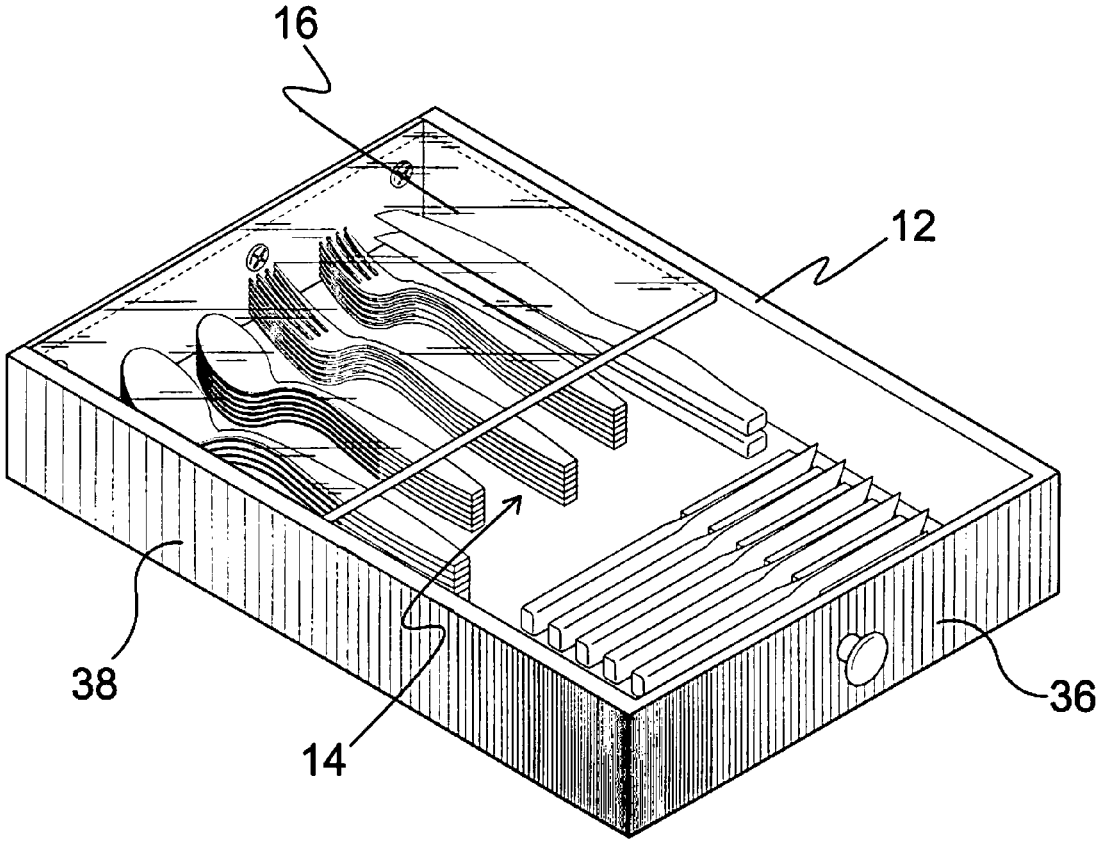
FIG. 7 is a perspective view of the present invention installed.

FIG. 7, is a perspective view of the present invention 10 installed in a drawer 12. The guard member 18 is shown transparent to allow the user to see the contents of the drawer 12 positioned there under. The cover is held in place with threaded fasteners 22 extending through the flange member 18 and into the drawer back 34. The free edge 20 of the guard member 18 may be tapered or sloping to prevent jamming against the cabinet fascia.

Figure 8:
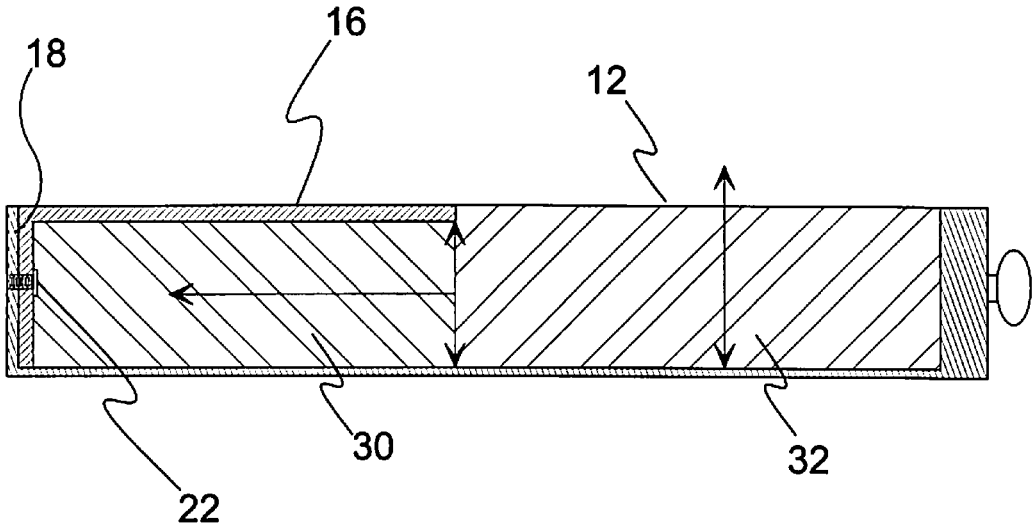
FIG. 8 is a sectional view of a drawer and a drawer cover with threaded fastener.

FIG. 8, is a sectional view of a cover of the present invention 10 installed in a drawer 12. At least one threaded fastener 22 is shown securing the flange member 18 to the drawer back 34. The cover while not impeding the space of the drawer 12, in essence it creates a bound portion 28 and an unbound portion 30 with no separation therebetween. The bound portion 28 limits the rise of any articles placed therein by the presence of the guard member 18. The cover has a width that is approximately equal to the distance between the drawer sides 34.

Figure 9:
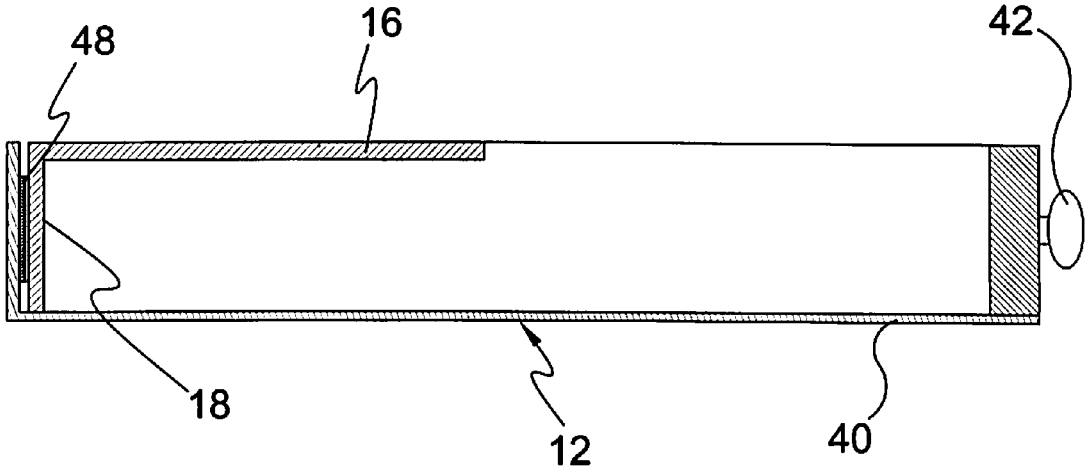
FIG. 9 is a sectional view of a drawer and a drawer cover with Velcro® fastener.

FIG. 9, is a sectional view of a drawer 12 and cover with a hook and loop fastener securing the cover to the drawer back 34. The cover is designed to prevent the articles within the drawer 12 from impeding its opening and closing. It is fastened to the interior surface of the drawer back 34 by at least one fastener. The at least one fastener may be a selectively releasable fastener, such as a hook and loop fastener 48 commonly known as Velcro®. The cover prevents the contents of the drawer 12 from rising above the top edge of drawer sides 38 for the bound portion 30. It is envisioned that the at least one fastener be color coded to match the color coding of the flange member 18. This will assist the user in positioning the cover in the proper drawer 12 if more than one cover is used. The threaded fastener(s) 22 and the hook and loop fastener(s) 48 may be color coded. The head of the threaded fastener 22 may employ the same color as the flange member 18 and the hook and loop fastener may employ the same color as the flange member 18.

I claim:

1. A cover secured to a drawer, the combination comprising:

said drawer having a flat bottom, a pair of flat side walls, a flat rear wall, and a flat front wall, said front wall having a handle on an outside surface for permitting said drawer to be moved into and out of a drawer opening;

the cover being L-shaped with a rear downwardly extending leg portion coextensive with an inner surface of said rear wall and a substantially planar guard portion extending from said rear leg portion, said guard portion being inside of said drawer and having an upper surface flush with but unattached to top edges of said rear and side walls and terminating in a front edge short of said front wall allowing objects to be placed in and removed from said drawer while preventing said objects in said drawer from impeding movement of said drawer into and out of said drawer opening, and a fastening arrangement that secures only the leg portion to a front surface of said rear wall of the drawer.

2. The combination of claim 1, wherein said guard portion is transparent.

3. The combination of claim 2, wherein said fastening arrangement comprises mating hook and loop segments mounted on the front surface of said rear wall and a rear surface of said leg portion allowing said cover to be readily installed in and removed from said drawer.

4. The combination of claim 3, wherein the front edge of said guard portion is tapered to prevent jamming when the drawer is opened and closed.

5. The combination of claim 4, wherein an upper surface of the guard member has indicia thereon.

6. The combination of claim 2, wherein the fastening arrangement comprises a threaded fastener for attaching said rear portion to said rear wall.

7. The combination of claim 6, wherein the leg portion has a keyhole shaped opening for engaging with and disengaging from a head of said threaded fastener in said rear wall allowing for convenient installation and removal of said cover.

8. The combination of claim 7, wherein the front edge of said guard portion is tapered to prevent jamming when the drawer is opened and closed.

9. The combination of claim 8, wherein an upper surface of the guard member has indicia thereon.

* * * * *